US008794004B2

(12) United States Patent
Inoue et al.

(10) Patent No.: US 8,794,004 B2
(45) Date of Patent: Aug. 5, 2014

(54) GAS TURBINE COMBUSTOR

(75) Inventors: Kei Inoue, Hyogo (JP); Keijiro Saito, Hyogo (JP); Yoshikazu Matsumura, Hyogo (JP); Sosuke Nakamura, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1078 days.

(21) Appl. No.: 12/666,673

(22) PCT Filed: Dec. 19, 2008

(86) PCT No.: PCT/JP2008/073177

§ 371 (c)(1),
(2), (4) Date: Dec. 24, 2009

(87) PCT Pub. No.: WO2009/081856

PCT Pub. Date: Jul. 2, 2009

(65) Prior Publication Data

US 2010/0319351 A1 Dec. 23, 2010

(30) Foreign Application Priority Data

Dec. 21, 2007 (JP) ..... 2007-329955

(51) Int. Cl.
*F02C 1/00* (2006.01)

(52) U.S. Cl.
USPC ..... 60/737; 60/748

(58) Field of Classification Search
USPC ..... 60/737, 738, 740, 746, 748, 749; 431/217, 354; 110/260–265
See application file for complete search history.

(56) References Cited

U.S. PATENT DOCUMENTS 4,044,553 A * 8/1977 Vaught ..... 60/39.23
4,534,166 A * 8/1985 Kelm et al. ..... 60/39.23

(Continued)

FOREIGN PATENT DOCUMENTS

| | | | |
|---|---|---|---|
| JP | 9-042672 | A | 2/1997 |
| JP | 2001-141241 | A | 5/2001 |
| JP | 2001-254946 | A | 9/2001 |
| JP | 2003-139326 | A | 5/2003 |
| JP | 2003-517553 | A | 5/2003 |
| JP | 2005-114193 | A | 4/2005 |

OTHER PUBLICATIONS

Decision to Grant a Patent dated Dec. 11, 2012, issued in corresponding Japanese Patent Application No. 2007-329955 (4 pages).

(Continued)

*Primary Examiner* — Ehud Gartenberg
*Assistant Examiner* — Arun Goyal
(74) *Attorney, Agent, or Firm* — Westerman, Hattori, Daniels & Adrian, LLP

(57) ABSTRACT

Provided is a gas turbine combustor capable of reducing the size of a low-temperature air layer of pilot air formed between a pilot flame and a premixed flame and of improving the flame stability of the premixed flame. A gas turbine combustor, which is provided with a pilot burner that is provided at the center portion of a combustor main body formed in a cylindrical shape to form a pilot flame, and a plurality of main burners arranged so as to surround the outer periphery of the pilot burner to form a premixed flame, includes, as the ignition improving part, a channel blocking member that reduces the size of the low-temperature air layer of the pilot air formed between the pilot flame and the premixed flame.

1 Claim, 12 Drawing Sheets

(56) References Cited

U.S. PATENT DOCUMENTS

| | | | | |
|---|---|---|---|---|
| 5,349,812 | A * | 9/1994 | Taniguchi et al. | 60/39.23 |
| 6,122,916 | A | 9/2000 | Amos et al. | |
| 2001/0022088 | A1 | 9/2001 | Mandai et al. | |

OTHER PUBLICATIONS

International Search Report of PCT/JP2008/073177, mailing date of Mar. 17, 2009.

* cited by examiner

GAS TURBINE COMBUSTOR

TECHNICAL FIELD

The present invention relates to a gas turbine combustor.

BACKGROUND ART

As shown in FIG. 12 for example, as a conventional gas turbine combustor 1, there is one having a structure in which a pilot burner 3 is arranged at the center position of a combustor main body 2 formed in a cylindrical shape, and a plurality of (for example, eight) main burners 10 are arranged at a uniform pitch in the circumferential direction so as to surround the periphery of the pilot burner 3.

The pilot burner 3 is provided with a pilot nozzle 4 and a pilot air channel 5 formed around the pilot nozzle 4. Pilot fuel supplied through the pilot nozzle 4 is combusted with pilot air supplied from the pilot air channel 5 and forms a pilot flame extending towards the rear side of a flame stabilizer 9. Note that, in the figure, reference numeral 6 is a pilot swirler that is disposed inside the pilot air channel 5 to form a swirling flow, and 7 is a pilot cone formed by expanding the diameter of the downstream end portion of a cylindrical member 8 forming the pilot air channel 5.

The main burner 10 is provided with a main nozzle 11 and a main air channel 12 that is formed at the periphery of the main nozzle 11. Main fuel supplied from the main nozzle 11 is premixed with main air supplied through the main air channel 12 to form premixed gas. This premixed gas is combusted downstream of the flame stabilizer 9 by ignition from the pilot flame. Note that, reference numeral 13 in the figure is a main swirler disposed in the main air channel 12, and it facilitates the premixing with the main fuel by causing the main air to form a swirling flow.

More specifically, in order to prevent or suppress combustion oscillation of about 30, to 80 Hz, which is governed by the flame stability, the above-described gas turbine combustor 1 forms a stable pilot flame (diffusion flame) by the diffusion combustion of the pilot burner 3 and is configured so as to stabilize the premixed flame obtained by combusting the premixed gas by means of ignition whereby this pilot flame bridges to the premixed gas of the main burner 10.

As a conventional technique for preventing combustion oscillation of gas turbine combustors, it has been proposed to extend the flame inside a combustion chamber by having different angles of two or more swirlers provided at the air inlet of premixing ducts. According to this conventional technique, it has been stated that since the generation of heat is spread by extending the flame length, the oscillating force would become smaller (for example, see Patent Citation 1).

Further, a gas turbine combustor has been proposed in which, in order to improve the ignition performance of the premixed gas in a premixed combustion region, air injecting means for injecting air towards the downstream side of a tip portion of a pilot cone is provided, and fuel injecting means for injecting fuel in a flame-stabilizing low speed region, or in the vicinity thereof, formed at the downstream side of a tip portion of a pilot cone is provided on the pilot cone (for example, see Patent Citation 2).

Patent Citation 1:, Japanese Unexamined Patent Application, Publication No. 2003-139326

Patent Citation 2:, Japanese Unexamined Patent Application, Publication No. 2005-114193

DISCLOSURE OF INVENTION

In the above-described conventional gas turbine combustor 1, because a cooler pilot air layer (hereinafter referred to as "low-temperature air layer") formed downstream of the flame stabilizer 9 inhibits the formation of the stable premixed flame, a problem that has been pointed out is that the flame stability of the premixed flame is deteriorated, which is one factor causing combustion oscillation.

More specifically, in the gas turbine combustor 1 shown in FIG. 12, the pilot air passing the pilot swirler 6 becomes a swirling air flow and reaches the flame stabilizer 9 along the inner surface of the pilot cone 7. This swirling air flow forms the low-temperature air layer between the pilot flame and the premixed flame downstream of the flame stabilizer 9.

Because this low-temperature air layer is an air layer having low temperature, it deteriorates the ignition with which the pilot flame forms the premixed flame by combusting the premixed gas; as a result, the combustion of the premixed gas will become unstable. Accordingly, in the gas turbine combustor 1, it is not possible to form a stable premixed flame; therefore, the flame stability of the premixed flame is deteriorated, causing combustion oscillation.

An object of the present invention, which has been made in light of the above circumstances, is to provide, a gas turbine combustor capable of reducing the size of a low-temperature air layer of pilot air formed between a pilot flame and a premixed flame and capable of improving the flame stability of the premixed flame.

In order to solve the problems described above, the present invention employs the following solutions.

A gas turbine combustor according to the present invention is provided with a pilot burner that is provided at the center portion of a combustor main body formed in a cylindrical shape to form a pilot flame, and a plurality of main burners arranged so as to surround the outer periphery of the pilot burner to form a premixed flame, the gas turbine combustor includes an ignition improving part that reduces the size of a low-temperature air layer of pilot air, formed between the pilot flame and the premixed flame.

According to such a gas turbine combustor, since the ignition improving part for reducing the size of the low-temperature air layer of the pilot air formed between the pilot flame and the premixed flame is provided, the low-temperature air layer is made thinner to reduce the distance between the premixed gas and the pilot flame, and thus, the ignition from the pilot flame to the premixed gas is improved.

In the above-mentioned invention, the ignition improving part is preferably a channel blocking member provided in the pilot swirler provided in a pilot air channel so as to block one or a plurality of air channels between vanes of the pilot swirler; accordingly, it is possible to form a region where the low-temperature air layer is thin downstream of the channel blocking member and to reduce the distance between the premixed gas and the pilot flame.

In the above-mentioned invention, the ignition improving part is preferably one or a plurality of plate-like projecting members projecting rearward from an outer edge of a pilot cone; accordingly, it is possible to reduce the distance between the premixed gas and the pilot flame by inducing a vortex in the flow of the pilot air with the plate-like projecting member and dragging a part of the premixed gas of the main burner towards the pilot burner.

In the above-mentioned invention, the ignition improving part is preferably a wedge-shaped vortex generator that has a sweepback angle and that is provided at one or a plurality of positions on an inner peripheral surface of an outer edge of a pilot cone; accordingly, it is possible to reduce the distance between the premixed gas and the pilot flame by inducing a vortex in the flow of the pilot air with the wedge-shaped vortex generator and dragging a part of the premixed gas of the main burner towards the pilot burner.

In the above-mentioned invention, the ignition improving part is preferably one or a plurality of flow-splitting members with a substantially triangular pole-shape provided on an inner peripheral surface of the pilot cone; accordingly, it is possible to reduce the distance between the premixed gas and the pilot flame by forming a region where the low-temperature air layer is thin downstream of the flow-splitting member.

In the above-mentioned invention, the ignition improving part is preferably a bypass channel that is formed at an outlet of the pilot cone and by which a part of the pilot air is branched to the main burner side; accordingly, it is possible to reduce the distance between the premixed gas and the pilot flame by forming a region where the low-temperature air layer is thin downstream of the bypass channel. In this case, bypass channels may be formed entirely or at intervals around the periphery in the circumferential direction of the pilot cone. Note that, since the flow rate of the pilot air being bypassed here is very small compared with the flow rate of the main air to be supplied to the main burner, an adverse effect like dilution of the premixed gas is negligible.

In the above-mentioned invention, the ignition improving part is preferably one or a plurality of flow-splitting members with a substantially triangular pole-shape provided at an outlet of a pilot swirler; accordingly, it is possible to reduce the distance between the premixed gas and the pilot flame by forming a region where the low-temperature air layer is thin downstream of the flow-splitting member.

In the above-mentioned invention, the ignition improving part is preferably one or a plurality of protruding parts formed on an inner wall surface by subjecting the pilot cone to press working; accordingly, it is possible to reduce the distance between the premixed gas and the pilot flame by forming a region where the low-temperature air layer is thin downstream of the protruding part.

In the above-mentioned invention, the ignition improving part is preferably a narrowed portion partially provided at an outlet of a swirler in a pilot air channel; accordingly, it is possible to reduce the distance between the premixed gas and the pilot flame by forming a region where the low-temperature air layer is thin downstream of the narrowed portion.

According to the above-described present invention, by providing an ignition improving part that reduces the size of a low-temperature air layer of pilot air formed between a pilot flame and a premixed flame, it is possible to reduce the distance between premixed gas and the pilot flame by making the low-temperature air layer thinner and to improve the ignition from the pilot flame to the premixed gas. As a result, the combustion of the premixed gas is stabilized, forming a stable premixed flame, and therefore, the combustion oscillation of the gas turbine combustor, which is governed by the flame stability of the premixed flame, can be corrected.

EXPLANATION OF REFERENCE

Figure 1:
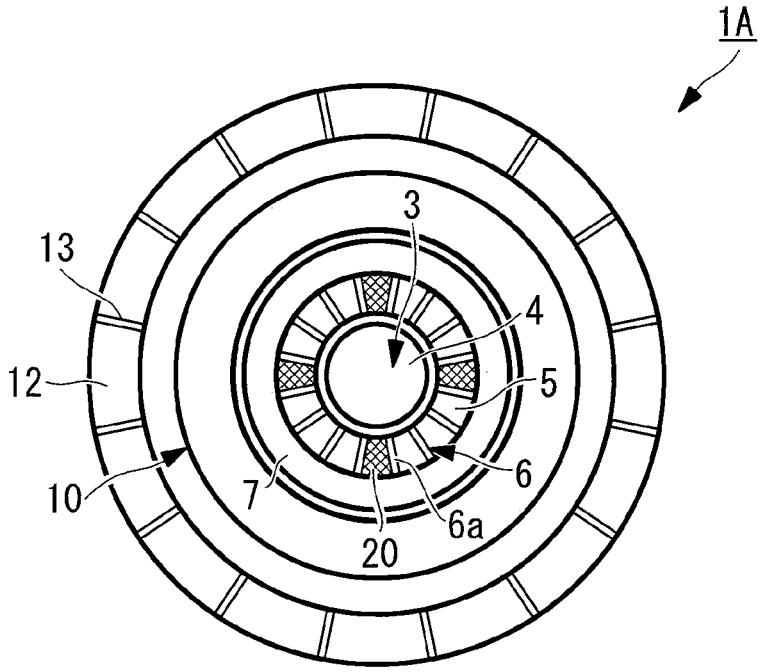
FIG. 1 is a configuration diagram of a first embodiment of a gas turbine combustor according to the present invention, showing a gas turbine combustor as viewed from the exit side.

1A to 1H: gas turbine combustor
2: combustor main body
3: pilot burner
4: pilot nozzle
5: pilot air channel
6: pilot swirler
7: pilot cone
8: cylindrical member
9: flame stabilizer
10: main burner
11: main nozzle
12: main air channel
13: main swirler
20: channel blocking member (ignition improving part)
21: plate-like projecting member (ignition improving part)
22: vortex generator (ignition improving part)
23, 26: flow-splitting member (ignition improving part)
24: bypass channel (ignition improving part)
27: protruding part (ignition improving part)
28: narrowed portion (ignition improving part)

Best Mode For Carrying Out The Invention

An embodiment of a gas turbine combustor according to the present invention will be described below based on the drawings.

<First Embodiment>

Figure 2:
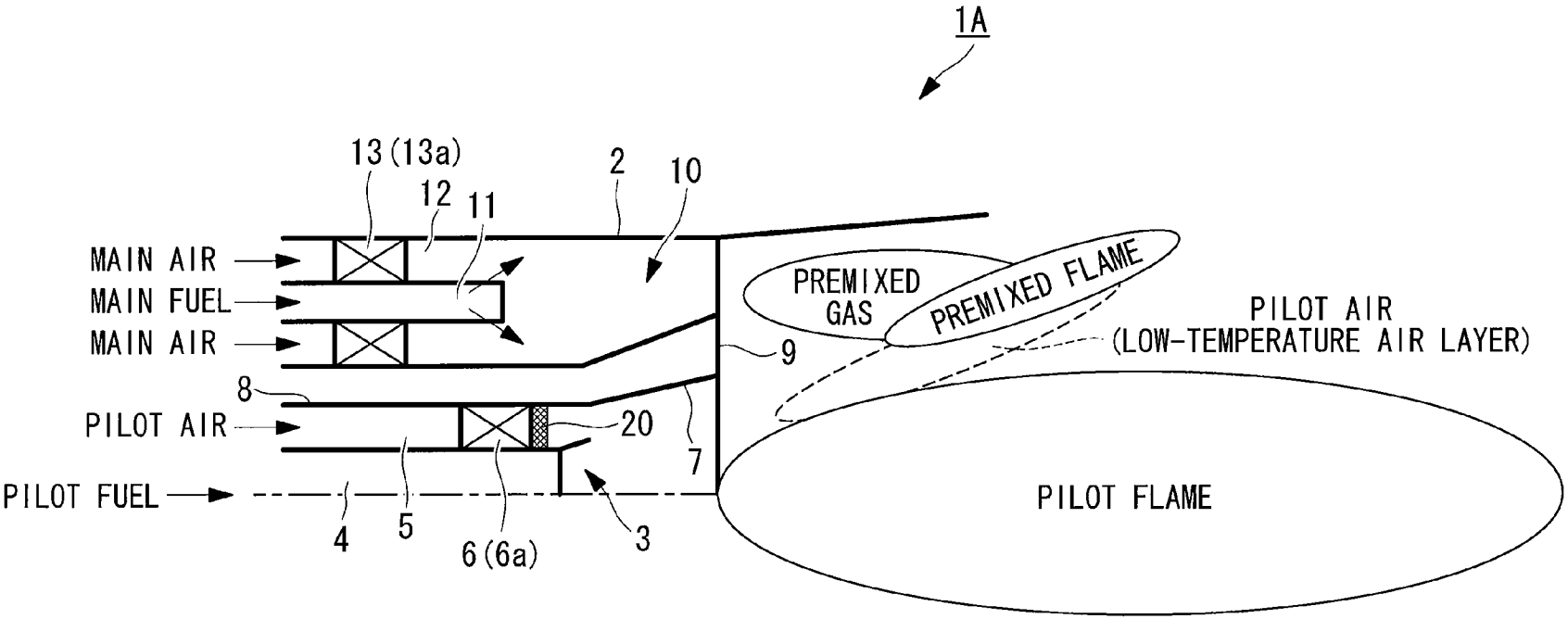
FIG. 2 is a sectional view of the gas turbine combustor shown in FIG. 1.

A gas turbine combustor 1A shown in FIG. 1 and FIG. 2 has a configuration in which a pilot burner 3 is provided at the center position of a combustor main body 2 formed in a cylindrical shape, and a plurality of (for example, eight) main burners 10 are provided at a uniform pitch in the circumferential direction so as to surround the periphery of this pilot burner 3.

The pilot burner 3 is provided with a pilot nozzle 4 that supplies pilot fuel and a pilot air channel 5 that is formed around the pilot nozzle 4 and supplies pilot air thereto. The pilot fuel supplied through the pilot nozzle 4 is combusted with the pilot air supplied from the pilot air channel 5 and, as shown in FIG. 2 for example, forms a pilot flame extending rearward of a flame stabilizer 9 from the combustor axial center.

A pilot swirler 6 that makes the flow of the pilot air become a swirling flow is disposed inside the above-described pilot air channel 5. This pilot swirler 6 partitions the interior of the pilot air channel 5 in the circumferential direction and is provided with a plurality of vanes 6*a*, that have a shape that exerts a swirl on the air flow and that are arranged at a uniform pitch. Further, in a cylindrical member 8 forming the pilot air channel 5, a pilot cone 7 formed by expanding the diameter of a downstream end portion thereof is provided.

The main burner 10 is provided with a main nozzle 11 that supplies main fuel and a main air channel 12 that is formed around the main nozzle 11 and supplies main air. After being injected from the main nozzle 11, the main fuel supplied from the main nozzle 11 is premixed with main air supplied through the main air channel 12 to form premixed gas. This premixed gas is combusted by ignition from the pilot flame downstream of the flame stabilizer 9.

A main swirler 13 that makes the flow of the main air become a swirling flow is disposed in the above-described main air channel 12. Premixing with the main fuel is facilitated with the main air that has become a swirling flow by passing through this main swirler 13.

Thus, for the gas turbine combustor 1A provided with the pilot burner 3 that is provided at the center part of the combustor main body 2 formed in a cylindrical shape and that forms the pilot flame and a plurality of main burners 10 that are provided so as to surround the outer periphery of the pilot burner 3 and that forms the premixed flame, in this embodiment, channel blocking members 20 that reduce the size of the low-temperature air layer of the pilot air formed between the pilot flame and the premixed flame are provided as an ignition improving part.

These channel blocking members 20 are disposed on the pilot swirler 6 provided in the pilot air channel 5 so as to block one or a plurality of positions among the air channels formed between the adjacent vanes 6*a*. In the illustrated example, four channel blocking members 20 are provided in the air channels between the vanes that are formed by partitioning the air channel 5 into sixteen portions in the circumferential direction by the sixteen vanes 6*a*, constituting the pilot swirler 6 so as to block four air channels between the vanes at a pitch of substantially 90-degree.

The thus-configured gas turbine combustor 1A forms a region where the low-temperature air layer is thin downstream of the channel blocking members 20; therefore, the distance formed between the premixed gas and the pilot flame can be reduced. This will be specifically described below based on FIG. 3.

Figure 3:
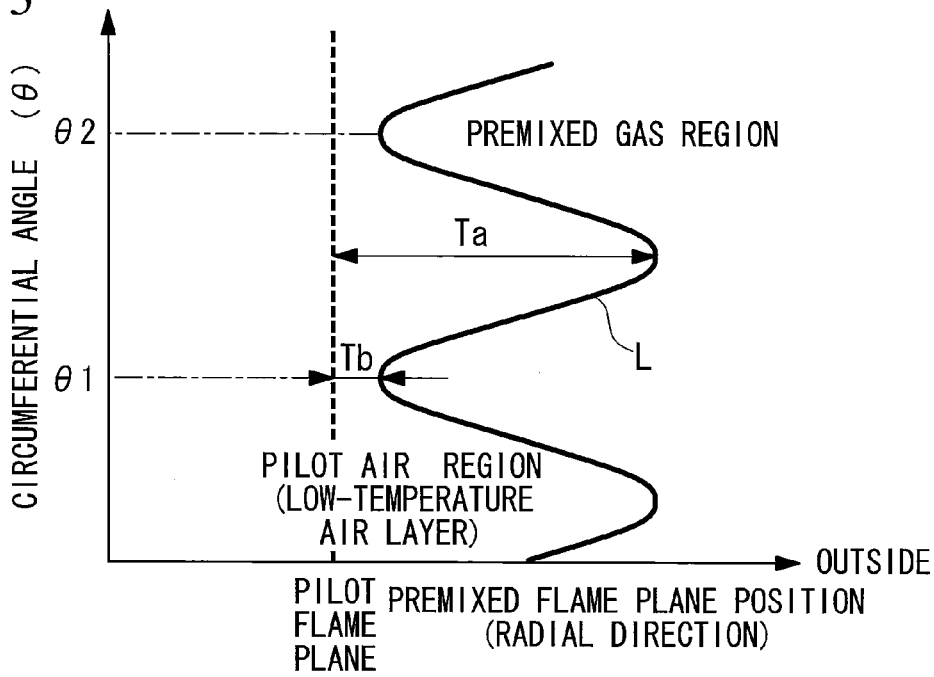
FIG. 3 is a view showing a boundary line L between a pilot air region and a premixed gas region for the gas turbine combustor shown in FIG. 1.

In FIG. 3, the horizontal axis is premixed flame plane positions in the gas turbine combustor 1, and a position more to the right-hand-side on the plane of the drawing is towards the outside in the radial direction. Further, the vertical axis in FIG. 3 is the circumferential angle of the gas turbine combustor 1, equivalent to the direction in which the above-described four channel blocking members 20 are disposed at a 90-degree pitch. According to this figure, a boundary line L, which is illustrated by a broken line, between the pilot air region of the low-temperature air layer formed outside the pilot flame plane and the premixed gas region in which premixed gas that has flowed out from the main burner 10 is present varies by following a substantially sinusoidal curve.

More specifically, in the sine curve L in FIG. 3, the thickness of the low-temperature air layer varies alternately from the thickest Ta to the thinnest Tb by following the sinusoidal curve. In this case, the circumferential angles corresponding to Tb where the low-temperature air layer is thinnest are positions θ1 and θ2, and the channel blocking members 20 disposed at a 90-degree pitch are present at these positions at the circumferential angles θ1 and θ2. The reason that the thickness of the low-temperature air layer becomes smaller downstream of the channel blocking members 20 in this way is because the flow rate of the low-temperature pilot air is decreased by blocking the channels of the pilot air flowing in the pilot air channel 5 with the channel blocking members 20.

Therefore, the gas turbine combustor lA provided with the above-described channel blocking member 20 is capable of reducing the distance between the premixed gas and the pilot flame by reducing the thickness of the low-temperature air layer, since the ignition improving part that reduces the size of the low-temperature air layer of the pilot air formed between the pilot flame and the premixed flame is provided. As a result, the influence of the low-temperature air layer on the pilot flame can be reduced, and so ignition of the premixed gas from the pilot flame can be improved. Since formation of a stable premixed flame becomes possible with the stabilized combustion of the premixed gas, the combustion oscillation of the gas turbine combustor 1A, which is governed by the flame stability of the premixed flame, can be improved.

In the above-described embodiment, although an example configuration in which four channel blocking members 20 are arranged at a 90-degree pitch is illustrated, it is only necessary to block at least one or a plurality of positions in the air channel among the gaps between, generally, about 8, to 20, vanes 6*a*, of the pilot swirler 6. Further, when a plurality of channel blocking members 20 are provided, although they may be arranged at a uniform pitch in the circumferential direction, it is desirable to arrange them at unequal pitches to achieve asymmetry, as a measure against combustion oscillation.

Further, the configuration of this embodiment becomes a simple configuration which is easy to work with since a modification of the structure of the cylindrical member 8 provided with the pilot cone 7 is unnecessary, and also since it is only necessary to block some of the gaps between the vanes 6*a*.

<Second Embodiment>

Figure 4:
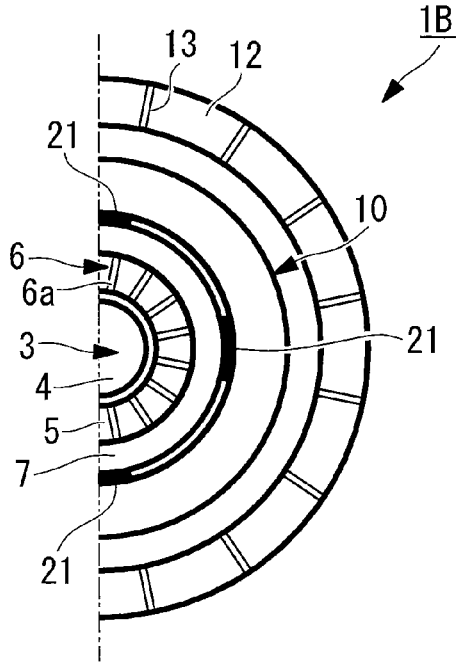
FIG. 4 is a right-hand-side configuration diagram of a second embodiment of a gas turbine combustor according to the present invention, showing a gas turbine combustor as viewed from the exit side.
Figure 5:
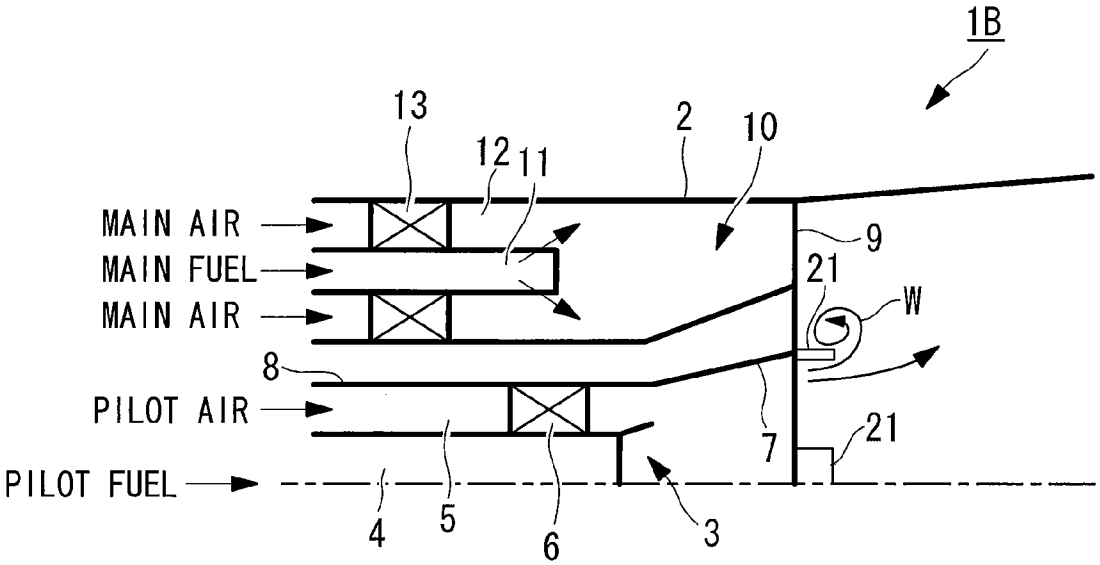
FIG. 5 is a sectional view of the gas turbine combustor shown in FIG. 2.

Next, for the gas turbine combustor according to the present invention, a second embodiment will be described based on FIG. 4 and FIG. 5. Note that, in the following description, parts similar to those in the above-described embodiment are assigned the same reference numerals, and a detailed description thereof will thus be omitted.

In this embodiment, a gas turbine combustor 1B is provided with one or a plurality of plate-like projecting members 21 projecting rearward from the outer edge of the pilot cone 7 as the ignition improving part. In the illustrated configuration, four plate-like projecting members 21 arranged at a 90-degree pitch in the circumferential direction are provided so as to project from the rear end of the pilot cone 7 towards the rear flame forming region. In other words, the cylindrical member 8 of this embodiment employs the pilot cone 7 having plate members 21 at the rear end.

By attaching such plate-like projecting members 21, the flow of the pilot air flowing out through the pilot air channel 5 can induce a vortex at the wake side of the plate-like projecting members 21 (see arrow W in the figure). When such a vortex is induced, a part of the premixed gas of the main burner 10 is dragged towards the pilot burner 3 due to the flow of the vortex. More specifically, in the flame forming region provided at the rear side of the flame stabilizer 9, since a part of the premixed gas approaches the pilot flame side, it is possible to reduce the distance between the premixed gas and the pilot flame as a whole.

As a result, since the influence of the low-temperature air layer on the pilot flame can be reduced, ignition of the premixed gas from the pilot flame can be improved. Since formation of a stable premixed flame becomes possible with the stabilized combustion of the premixed gas, the combustion oscillation of the gas turbine combustor 1A, which is governed by the flame stability of the premixed flame, can be improved.

In the above-described embodiment, although four plate-like projecting members 21 are provided at a 90-degree pitch, at least one or a plurality of plate-like projecting members 21 may be provided. At this time, it is not necessary to arrange the plate-like projecting members 21 at a uniform pitch in the circumferential direction; it is desirable to arrange them at unequal pitches to achieve asymmetry, as a measure against combustion oscillation.

<Third Embodiment>

Figure 6A:
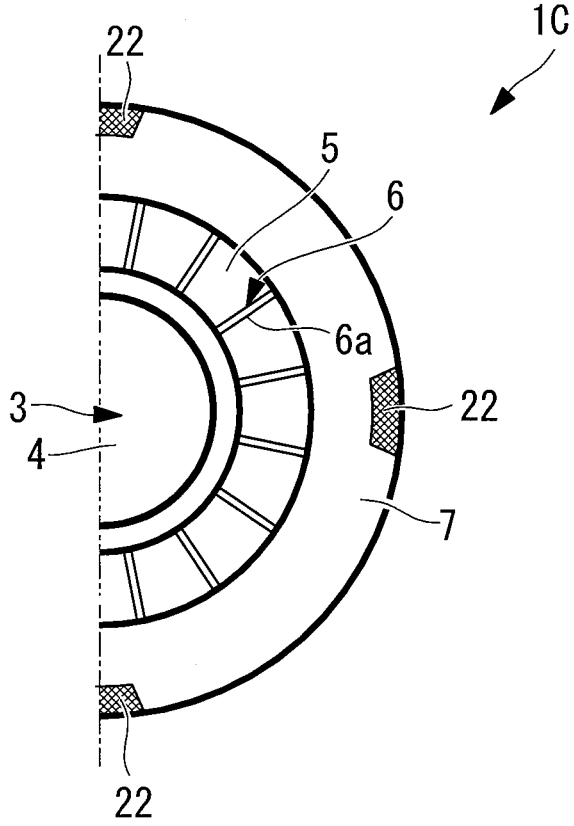
FIG. 6A is a view showing a third embodiment of a gas turbine combustor according to the present invention and is a right-hand-side configuration diagram showing the gas turbine combustor as viewed from the exit side.

Next, for the gas turbine combustor according to the present invention, a third embodiment will be described based on FIG. 6A to FIG. 6C. In a gas turbine combustor 1C in FIG. 6A used here, the outer peripheral side main burner is omitted, and only the pilot burner is illustrated. Note that, in the following description, parts similar to those in the above-described embodiments are assigned the same reference numerals, and a detailed description thereof will thus be omitted.

In this embodiment, as the ignition improving part, wedge-shaped vortex generators 22 having a sweepback angle are provided at one or a plurality of positions on the inner peripheral surface of the locations corresponding to the outer edge of the pilot cone 7. In the illustrated configuration, four wedge-shaped vortex generators 22 arranged at a 90-degree pitch in the circumferential direction are provided on the inner peripheral surface of the outer edge of the pilot cone 7. In other words, the cylindrical member 8 in this embodiment employs the pilot cone 7 having the wedge-shaped vortex generators 22 on the inner peripheral surface of the outer edge.

Here, the structure of the wedge-shaped vortex generators 22 will be described in detail.

Figure 6B:
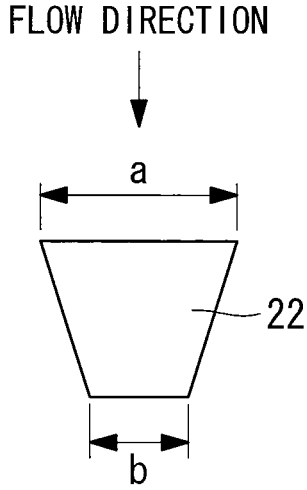
FIG. 6B is a diagram showing a vortex generator in FIG. 6A as viewed from the axial center of a pilot cone.
Figure 6C:
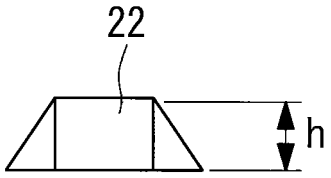
FIG. 6C is a diagram showing the vortex generator of FIG. 6B as viewed from the downstream side.

As shown in FIG. 6B, the wedge-shaped vortex generators 22 have a sweepback angle in which, with regard to the dimension (width) intersecting the flow direction, the upstream width a is wider than the downstream width b. Further, as shown in FIG. 6C, the wedge-shaped vortex generators 22 have a wedge-shape in which the height dimension h in the flow direction increases from the upstream side where the height is the same as the inner peripheral surface of the outer edge of the pilot cone 7 (h=0) towards the downstream side.

Even with such a configuration, since the wedge-shaped vortex generators 22 induce the vortex in the flow of the pilot air, a part of the premixed gas of the main burner 10 is dragged towards the pilot burner. In other words, in the flame forming region provided at the rear side of the flame stabilizer 9, since a part of the premixed gas approaches the pilot flame side, it is possible to reduce the distance between the premixed gas and the pilot flame as a whole.

As a result, since the influence of the low-temperature air layer on the pilot flame can be reduced, ignition of the premixed gas from the pilot flame can be improved. Since formation of a stable premixed flame becomes possible with the stabilized combustion of the premixed gas, the combustion oscillation of the gas turbine combustor 1C, which is governed by the flame stability of the premixed flame, can be improved.

In the above-described embodiment, although four wedge-shaped vortex generators 22 are provided at a 90-degree pitch, at least one or a plurality of wedge-shaped vortex generators 22 may be disposed. At this time, it is not necessary to arrange the wedge-shaped vortex generators 22 at a uniform pitch in the circumferential direction; it is desirable to arrange them at unequal pitches to achieve asymmetry, as a measure against combustion oscillation.

<Fourth Embodiment>

Figure 7A:
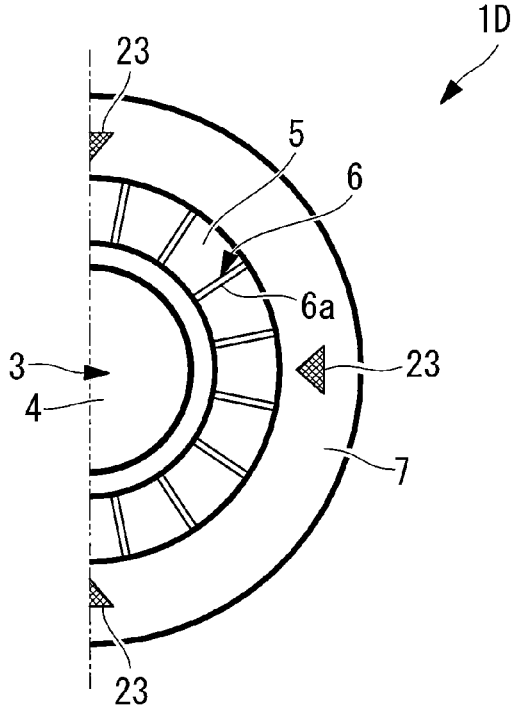
FIG. 7A is a view showing a fourth embodiment of a gas turbine combustor according to the present invention and is a right-hand-side configuration diagram showing the gas turbine combustor as viewed from the exit side.
Figure 7B:
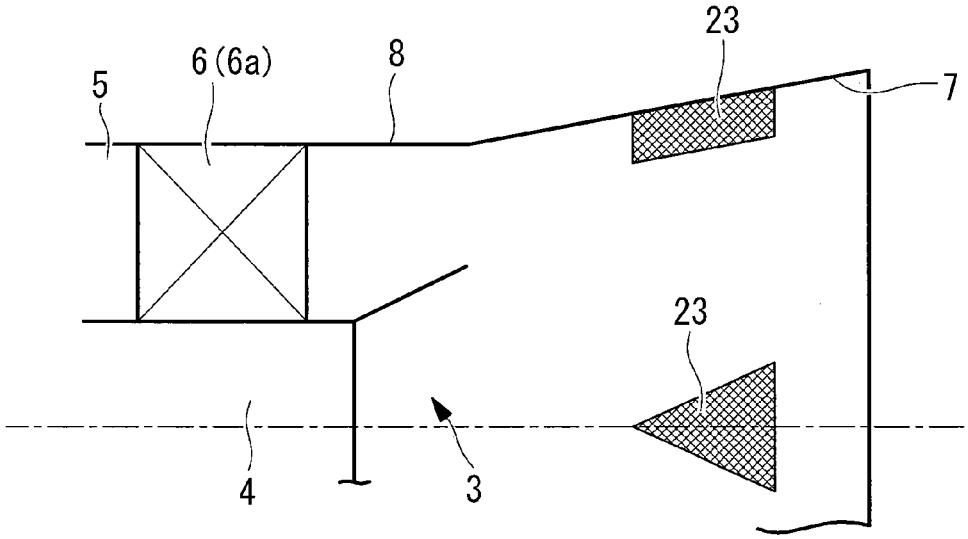
FIG. 7B is a sectional view of FIG. 7A.

Next, for the gas turbine combustor according to the present invention, a fourth embodiment will be described based on FIG. 7A and FIG. 7B. In a gas turbine combustor 1D in FIG. 7A used here, the outer peripheral side main burner is omitted, and only the pilot burner is illustrated. Note that, in the following description, parts similar to those in the above-described embodiments are assigned the same reference numerals, and a detailed description thereof will thus be omitted.

In this embodiment, as the ignition improving part, one or a plurality of flow-splitting members 23 with a substantially triangular pole-shape are provided on the inner peripheral surface of the pilot cone 7. These flow-splitting members 23 are disposed so that the angled tip portion of the triangular pole is located at the upstream side, and the width thereof increases gradually towards the downstream side.

With such a configuration, since the region in which the thickness of the low-temperature air layer is small is formed downstream of the flow-splitting members 23, it is possible to reduce the distance between the premixed gas and the pilot flame.

As a result, since the influence of the low-temperature air layer on the pilot flame can be reduced, ignition of the premixed gas from the pilot flame can be improved. Since formation of a stable premixed flame becomes possible with the stabilized combustion of the premixed gas, the combustion oscillation of the gas turbine combustor 1D, which is governed by the flame stability of the premixed flame, can be improved.

In the above-described embodiment, although four flow-splitting members 23 are provided at a 90-degree pitch, at least one or a plurality of flow-splitting members 23 may be disposed. At this time, it is not necessary to arrange the flow-splitting members 23 at a uniform pitch in the circumferential direction; it is desirable to arrange them at unequal pitches to achieve asymmetry, as a measure against combustion oscillation.

<Fifth Embodiment>

Figure 8:
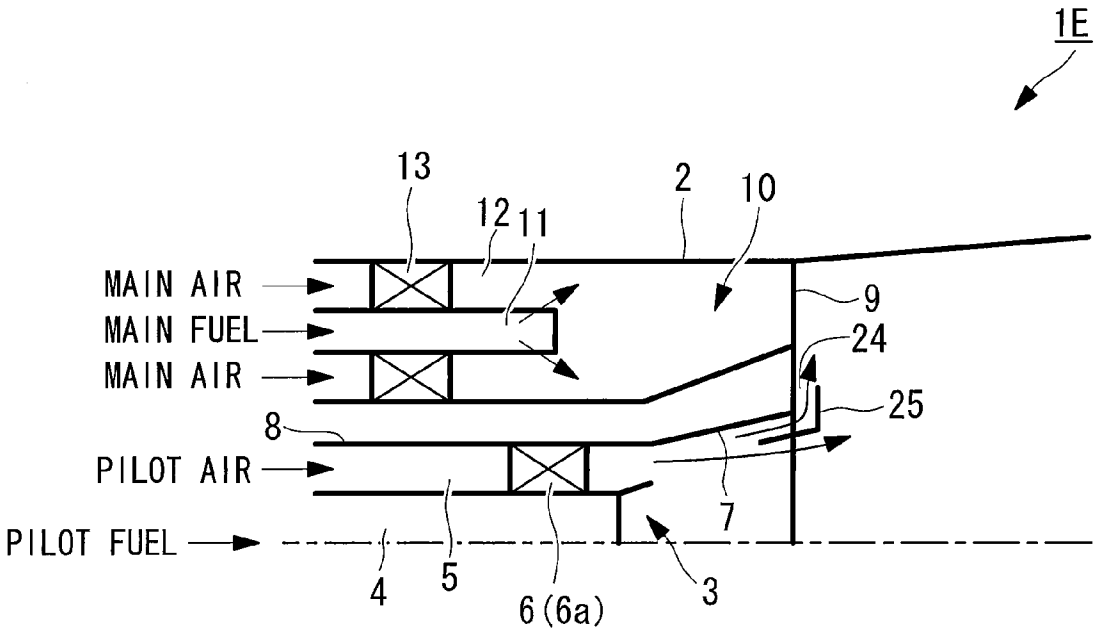
FIG. 8 is a sectional view of a fifth embodiment of a gas turbine combustor according to the present invention, showing an example configuration of a gas turbine combustor.

Next, for the gas turbine combustor according to the present invention, a fifth embodiment will be described based on FIG. 8. Note that, in the following description, parts similar to those in the above-described embodiments are assigned the same reference numerals, and a detailed description thereof will thus be omitted.

In this embodiment, a gas turbine combustor 1E is provided with, as the ignition improving part, a bypass channel 24 that is formed at the outlet of the pilot cone 7 and with which a part of the pilot air is branched to the main burner 10 side. Although this bypass channel 24 is formed by attaching, for example, a substantially L-shaped cross-section member 25 to the outlet of the pilot cone 7, there is no particular limitation as long as a part of the pilot air is actively guided to the main burner 10 side.

With the thus-configured gas turbine combustor 1E, since a part of the pilot air is branched to the main burner 10 side through the bypass channel 24, the thickness of the low-temperature air layer formed around the pilot flame becomes smaller by an amount corresponding to the decrease due to the branched pilot air. Therefore, it is possible to form a region where the low-temperature air layer is thin downstream of the bypass channel 24 and to reduce the distance between the premixed gas and the pilot flame. In this case, the bypass channel 24 may be formed around the entire periphery or at intervals in the circumferential direction of the pilot cone 7. Further, when the bypass channels 24 are formed at intervals in the circumferential direction, it is not necessary to arrange the bypass channels 24 at a uniform pitch in the circumferential direction; it is desirable to arrange them at unequal pitches to achieve asymmetry, as a measure against combustion oscillation.

Note that, since the flow rate of the pilot air being bypassed here is very small compared with the flow rate of the main air to be supplied to the main burner 10, an adverse effect like dilution of the premixed gas at the main burner 10 side is negligible.

As a result, since the influence of the low-temperature air layer on the pilot flame can be reduced, ignition of the premixed gas from the pilot flame can be improved. Since formation of a stable premixed flame becomes possible with the stabilized combustion of the premixed gas, the combustion oscillation of the gas turbine combustor 1E, which is governed by the flame stability of the premixed flame, can be improved.

<Sixth Embodiment>

Figure 9A:
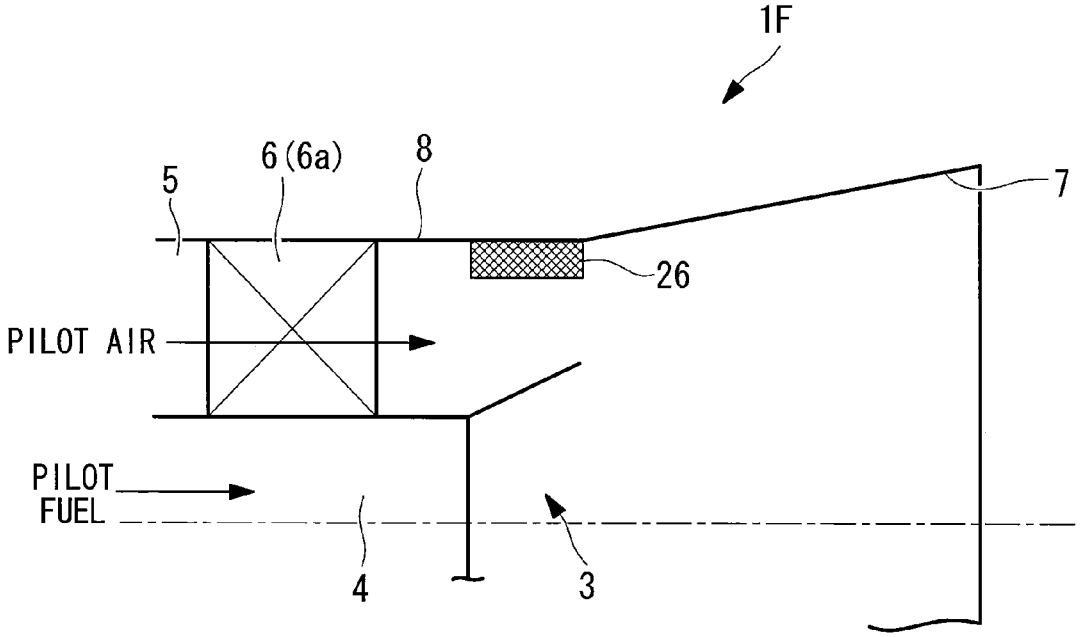
FIG. 9A is a view showing a sixth embodiment of a gas turbine combustor according to the present invention and is a sectional view showing an example configuration of a gas turbine combustor.
Figure 9B:
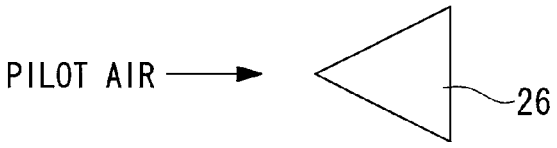
FIG. 9B is a diagram showing the flow-splitting members in FIG. 9A as viewed from the axial center side of a pilot cone.

Next, for the gas turbine combustor according to the present invention, a sixth embodiment will be described based on FIG. 9A and FIG. 9B. In a gas turbine combustor 1F in FIG. 9A used here, the outer peripheral side main burner is omitted, and only the pilot burner is illustrated. Note that, in the following description, parts similar to those in the above-described embodiments are assigned the same reference numerals, and a detailed description thereof will thus be omitted.

In this embodiment, as the ignition improving part, one or a plurality of flow-splitting members 26 with a substantially triangular pole-shape are provided at the outlet of the pilot swirler 6. These flow-splitting members 26 are disposed so that the angled tip portion of the triangular pole is located at the upstream side, and the width thereof increases gradually towards the downstream side.

With such a configuration, since the region in which the thickness of the low-temperature air layer is small is formed downstream of the flow-splitting members 26, it is possible to reduce the distance between the premixed gas and the pilot flame.

As a result, since the influence of the low-temperature air layer on the pilot flame can be reduced, ignition of the premixed gas from the pilot flame can be improved. Since formation of a stable premixed flame becomes possible with the stabilized combustion of the premixed gas, the combustion oscillation of the gas turbine combustor 1D, which is governed by the flame stability of the premixed flame, can be improved.

In the above-described embodiment, although four flow-splitting members 26 are provided at a 90-degree pitch, at least one or a plurality of flow-splitting members 26 may be disposed. At this time, it is not necessary to arrange the flow-splitting members 26 at a uniform pitch in the circumferential direction; it is desirable to arrange them at unequal pitches to achieve asymmetry, as a measure against combustion oscillation.

<Seventh Embodiment>

Figure 10:
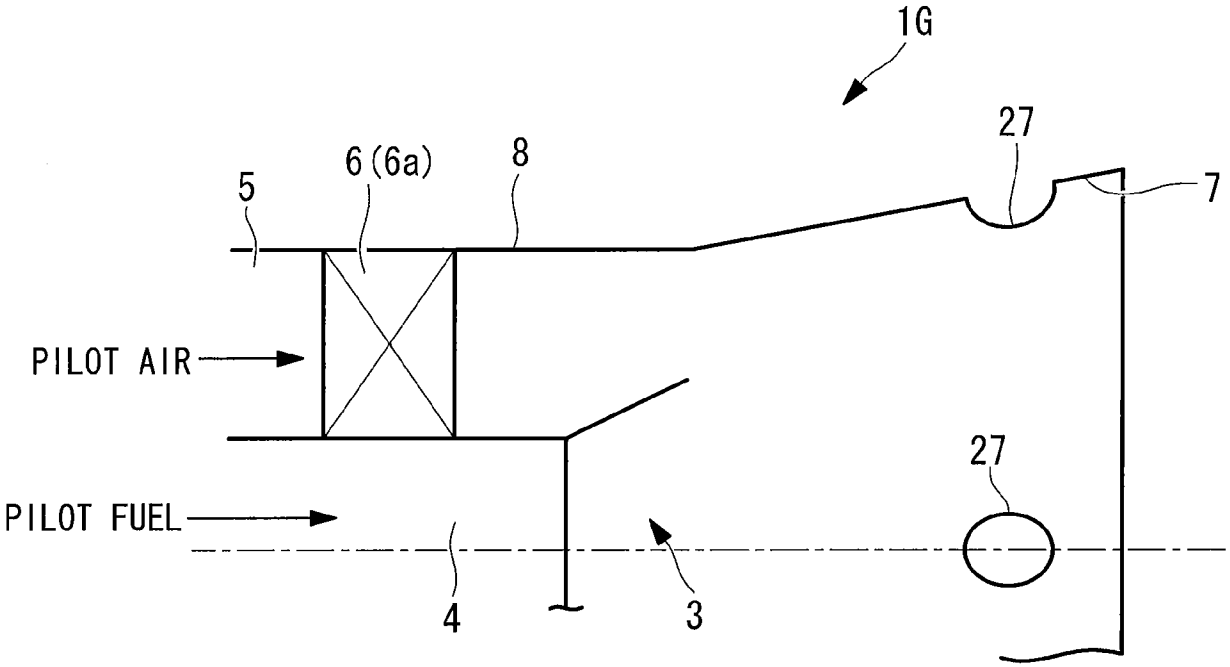
FIG. 10 is a sectional view of a seventh embodiment of a gas turbine combustor according to the present invention, showing an example configuration of a gas turbine combustor.

Next, for the gas turbine combustor according to the present invention, a seventh embodiment will be described based on FIG. 10. In a gas turbine combustor 1G in FIG. 10 used here, the outer peripheral side main burner is omitted, and only the pilot burner is illustrated. Note that, in the following description, parts similar to those in the above-described embodiments are assigned the same reference numerals, and a detailed description thereof will thus be omitted.

In this embodiment, as the ignition improving part, one or a plurality of protruding parts 27 that are formed on the inner wall surface by subjecting the pilot cone 7 to the press working are provided. These protruding parts 27 are a low-cost structure since they are formed by subjecting the pilot cone 7 to partial press working from the outside to cause the inner peripheral surface to protrude inwardly.

With such a configuration, since the region in which the thickness of the low-temperature air layer is small is formed downstream of the protruding parts 27 in a similar fashion as with the above-described flow-splitting members 23, 26 etc., it is possible to reduce the distance between the premixed gas and the pilot flame.

As a result, since the influence of the low-temperature air layer on the pilot flame can be reduced, ignition of the premixed gas from the pilot flame can be improved. Since formation of a stable premixed flame becomes possible with the stabilized combustion of the premixed gas, the combustion oscillation of the gas turbine combustor 1G, which is governed by the flame stability of the premixed flame, can be improved.

In this illustrated embodiment, although four protruding parts 27 are provided at a 90-degree pitch, at least one or a plurality of protruding parts 27 may be disposed. At this time, it is not necessary to arrange the protruding parts 27 at a uniform pitch in the circumferential direction; it is desirable to arrange them at unequal pitches to achieve asymmetry, as a measure against combustion oscillation.

<Eighth Embodiment>

Figure 11A:
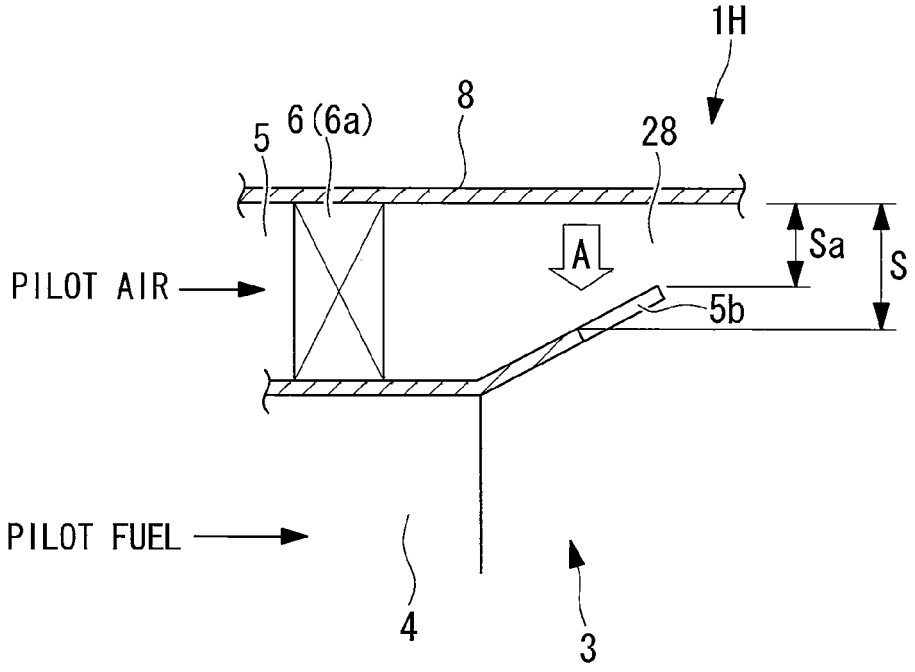
FIG. 11A is a view showing an eighth embodiment of a gas turbine combustor according to the present invention and is a sectional view showing an example configuration of principal parts.
Figure 11B:
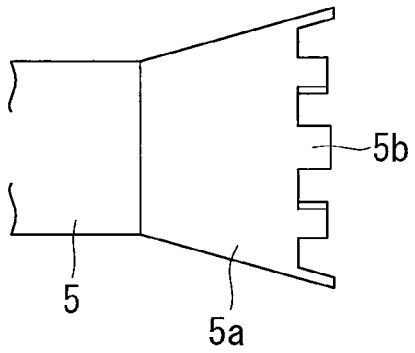
FIG. 11B is a side view taken from arrow A in FIG. 11A.
Figure 12:
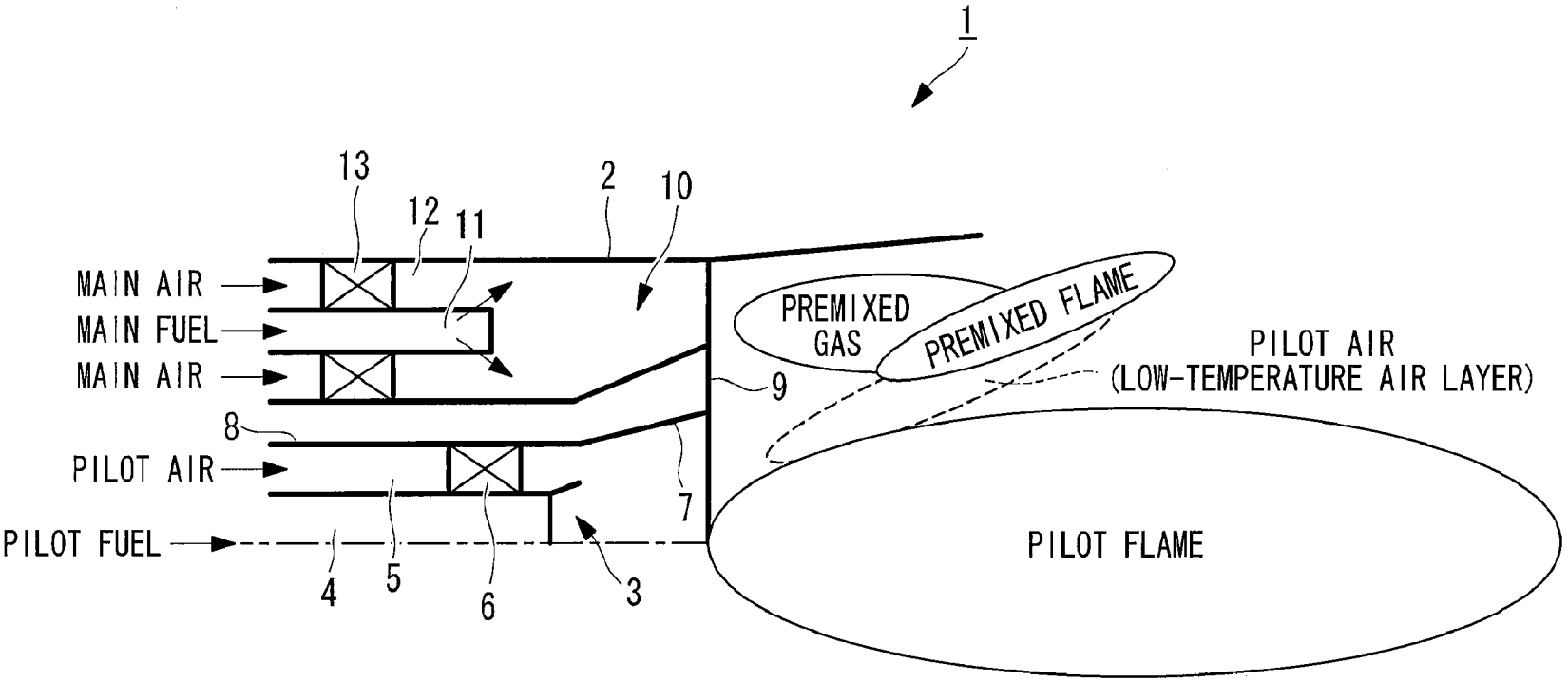
FIG. 12 Prior Art
FIG. 12 is a sectional view showing an example configuration of a conventional gas turbine combustor.

Next, for the gas turbine combustor according to the present invention, an eighth embodiment will be described based on FIG. 11A and FIG. 11B. In a gas turbine combustor 1H in FIG. 11A used here, the outer peripheral side main burner is omitted, and only the pilot burner is illustrated. Note that, in the following description, parts similar to those in the above-described embodiments are assigned the same reference numerals, and a detailed description thereof will thus be omitted.

In this embodiment, as the ignition improving part, partially narrowed portions 28 are provided at a swirler outlet of the pilot air channel 5. These narrowed portions 28 are formed by partially extending a rear-end cone part 5*a* of the pilot nozzle 4 whose diameter is expanded towards the wake side.

Specifically, by alternately providing, in the circumferential direction, tongue-shaped parts 5*b*, that have been formed by extending the rear end of the rear-end cone part 5*a*, to the rear side at intervals, the narrowed portions 28 in which the normal channel dimension S has been narrowed to Sa are formed at the swirler outlet of the pilot air channel 5.

By forming such narrowed portions 28, a region where the low-temperature air layer is thin can be formed downstream of the narrowed portions 28, and therefore, it is possible to reduce the distance between the premixed gas and the pilot flame.

As a result, since the influence of the low-temperature air layer on the pilot flame can be reduced, ignition of the premixed gas from the pilot flame can be improved. Since formation of a stable premixed flame becomes possible with the stabilized combustion of the premixed gas, the combustion oscillation of the gas turbine combustor 1H, which is governed by the flame stability of the premixed flame, can be improved.

In the above-described embodiment, although the tongue-shaped parts 5*b*, are provided at a uniform pitch around the entire periphery in the circumferential direction, these tongue-shaped parts 5*b*, may be either disposed at a part of the circumferential direction or disposed at unequal pitches in the circumferential direction.

According to the above-described gas turbine combustors 1A to 1H, a stable pilot flame (diffusion flame) is formed by means of the diffusion combustion of the pilot burner 2; and with the improved ignition by which this pilot flame bridges to the premixed gas of the main burner 10, the premixed flame obtained by the combustion of the premixed gas will also be stabilized. In other words, the combustion of the premixed gas is stabilized, forming a stable premixed flame, and so the combustion oscillation of the gas turbine combustor, which is governed by the flame stability of the premixed flame, can be improved.

Note that, the present invention is not limited to the above-described embodiments; suitable modifications, such as, for example, employing suitably combined configurations of each embodiment, are possible without departing from the spirit of the invention.

The invention claimed is:

1. A gas turbine combustor provided with a pilot burner that is provided at the center portion of a combustor main body formed in a cylindrical shape to form a pilot flame, and a plurality of main burners arranged so as to surround the outer periphery of the pilot burner to form a premixed flame by combusting a premixed gas, the gas turbine combustor comprising:

a pilot air channel formed in the pilot burner;

a pilot swirler provided in the pilot air channel; and a channel blocking member adapted to be disposed on the pilot swirler, wherein the channel blocking member is disposed on the pilot swirler to reduce the size of a low-temperature air layer of pilot air, the low-temperature air layer being formed between the pilot flame and the premixed flame, and to reduce the distance between the premixed gas and the pilot flame so as to close off a gap between one or a plurality of air channels between vanes of the pilot swirler.

* * * * *